United States Patent [19]

Graushar

[11] Patent Number: 5,013,022

[45] Date of Patent: May 7, 1991

[54] APPARATUS AND METHOD FOR ASSEMBLING SIGNATURES

[75] Inventor: William T. Graushar, Wauwatosa, Wis.

[73] Assignee: Quad/Tech, Inc., Pewaukee, Wis.

[21] Appl. No.: 395,894

[22] Filed: Aug. 18, 1989

[51] Int. Cl.[5] ..... B65H 43/02

[52] U.S. Cl. ..... 270/56; 271/4; 198/347.1; 414/331; 270/58

[58] Field of Search ..... 270/54, 56, 58; 271/4, 271/6, 7, 10; 198/347.1; 414/331

[56] References Cited

U.S. PATENT DOCUMENTS

| | | | |
|---|---|---|---|
| 3,608,888 | 10/1969 | McCain et al. | 270/54 |
| 3,660,639 | 5/1972 | Cassel | 271/4 |
| 3,899,165 | 8/1975 | Abrams et al. . | |
| 3,966,186 | 6/1976 | Helm | 270/58 |
| 4,022,455 | 5/1977 | Newsome et al. . | |
| 4,576,370 | 3/1986 | Jackson | 270/54 |
| 4,582,312 | 4/1986 | Abrams et al. | 270/54 |
| 4,778,167 | 10/1988 | Snow et al. . | |
| 4,799,661 | 1/1989 | Nail | 270/54 |
| 4,800,505 | 1/1989 | Axelrod et al. | 270/58 |
| 4,867,432 | 9/1989 | Matta | 270/54 |

OTHER PUBLICATIONS

Graphic Arts Monthly, Jul. 1979, Hartsuch, P. J. "Printers & Publishers Discuss Bindery Needs & Innovations at R & E Council in Chicago" copy in 270/54, pp. 100-104.

Computer Design (USA) vol. 14, No. 10. Oct. 1975, Dove, R. K., "OCR System Design Benefits from Technological Advances" p. 92, copy in 271/6.

*Primary Examiner*—John T. Kwon
*Assistant Examiner*—F. Daniel Lopez
*Attorney, Agent, or Firm*—Foley & Lardner

[57] ABSTRACT

An assembly system for demographic binding of signatures into a book on a collating and binding line includes a device for reading coded information printed directly on selected signatures, a feeder for supplying the coded signatures to the collating and binding line and an accumulator for transmitting the coded signatures to the collating and binding line in sequence with signatures being gathered on the line according to the information on the coded signatures.

23 Claims, 4 Drawing Sheets

APPARATUS AND METHOD FOR ASSEMBLING SIGNATURES

TECHNICAL FIELD

The present invention relates generally to an apparatus and method for assembling signatures into booklet or magazine form and, more particularly, to an apparatus and method of utilizing coded information on a selected signature representative of demographic and geographic factors to control assembly of signatures into various magazine or booklet versions.

BACKGROUND OF THE INvENTION

Collating and binding systems for saddle stitchers are, of course, well known in the printing industry for mass producing booklets, magazines, catalogues, advertising brochures and the like. Typically, one or more sharply folded and generally pre-printed blanks or signatures are sequentially fed by a number of spaced signature feeders. The signatures are delivered such that the folded margins or spines of the signatures come to rest upon a collating conveyor line or chain which travels past the signature feeders. The conveyor gathers the signatures, one on top of the other, and moves them, through one or more on-line printing stations, to a stitching or binding station. The assembled signatures then are usually diverted to a trimming station and further led to a labeling station where mailing labels which are pre-printed or printed on-line are affixed.

Prior art systems of this type contemplate the computer controlled production of various demographic editions of books or catalogues of internal and external signatures containing individually tailored information or customized printing on selected signatures. This flexibility is important in satisfying the demands of a particular market or geographical destination. For instance, it may be desirable to offer certain customers or subscribers various features or selected advertising depending upon their special interest, income or occupation. Likewise, it may be relevant to customize products or services contingent upon a customer's previous buying history. For example, a publication may issue one demo edition for parents of newborn children who have purchased baby products, another edition for farmers interested in the latest milking machines and still another edition for fitness buffs who have ordered exercise equipment. In each situation, it is important to realize that a publisher may save significant postal costs by presorting these demographic editions. In postal terms, this means the combining of demographic editions into a singular mailstream to maximize five digit and carrier route sortings.

To provide these demographic versions, the prior art commonly employs an information source which indicates the special interest of each subscriber within a common postal locale. Based on the information source, a controller selectively actuates the signature feeders to deliver certain signatures upon the conveyor to form one or more editions of a booklet or magazine for each subscriber within the zip code area. Each new zip code area is accompanied by a new sequence demand.

One system which discloses the demographic binding of signatures is shown in U.S. Pat. No. 3,899,165 issued on Aug. 12, 1975 to Abram et al. In this arrangement, each signature feeder is actuated under control of coding on optically scanned mailing labels carried on a tape located adjacent the labeling station. The efficiency of this system is dependent upon the conveyance of the label in synchronism with the conveyor in order that the correct label is placed on the cover signature of the booklet produced by the coding on the label. In addition, this arrangement includes a replacement book feeder which supplies a standard replacement book in the line upon detection of a malfunction. While this prevents a loss in synchronism between the gathered signatures and the information source controlling feeding of the signatures, the subscriber affected will not receive the demographic edition originally programmed.

Another collating system in which a tape is employed to determine the construction of booklets is shown in U.S. Pat. No. 4,778,167 issued Oct. 18, 1988 to Snow et al. In this design, detection of a malfunction will cause a booklet of a particular version to be reordered, but there is no guarantee that the reordered book will be properly bundled with booklets in the same zip code. As a result, a publisher may incur further postal expenditures due to the creation of these maverick or stray booklets relative to the remainder of booklets in the same geographic grouping.

A further demographic binding machine utilizing a coded address label to determine book make-up is disclosed in U.S. Pat. No. 4,022,455 issued May 10, 1977 to Newsome et al. In this machine, a plurality of parallel conveyor belts are used as storage stations between signature feeders and the labelling table to hold various editions of magazines on call. While the provision of the storage stations may improve the availability of demographic editions of prior art systems, it adds a substantial additional expense by virtue of its extra conveyors, and attendant vanes, solenoids and delay devices utilized therewith.

From the foregoing, it can be seen that various attempts have been made by the prior art to upgrade the assembly of signatures in a demographic binding operation. However, there remains a need in this well developed art for a system which offers more efficient handling of signatures and bundling of magazines with optimized postal discounts.

SUMMARY OF THE INVENTION

The present invention advantageously provides an improved assembly and sorting capability for the high speed collating and binding of customized books of signatures. The improved assembly system provides noteworthy versatility and is readily adaptable into existing systems with a minimum of modification.

These and other advantages are realized, in one aspect of the invention, by a system for selectively assembling signatures into a book on a collating and binding line according to coded information and including a feeder for supplying signatures bearing coded information to the line and an accumulator between the feeder and the line for delivering the coded signatures to the line in synchronism with the signatures being assembled on the line according to the information on the coded signatures.

The present invention also relates to a method for selectively assembling signatures on a collating and binding line into books of various demographic editions including the reading of coded information representative of demographic characteristics on selected signatures to initiate the assembling of selected signatures on the line and the delivering of the selected signatures to the line in synchronism with the signatures being assembled on the line according to coded information on the selected signatures.

In a highly preferred embodiment, the present invention contemplates a portable design easily incorporated into the collating and binding line. The system embodying the present invention combines the delivery of certain signatures to the collating and binding line with the reading of coded demographic information provided directly on the selected signatures to provide a more efficient binding operation. The selected signatures carrying the coded demographic information which control the binding are strategically fed and monitored from a position in the pocket of a feeder such that if a problem occurs in the feeding of a selected signature, that signature may be timely refed in order to ensure the integrity of the demographic edition being sorted and thereby optimize postal discounts.

BRIEF DESCRIPTION OF THE DRAWING

The invention will become better understood by reference to the following detailed description of the preferred exemplary embodiment when read in conjunction with the appended drawing wherein like numerals denote like elements and.

DETAILED DESCRIPTION OF THE PREFERRED EMBODIMENT

Figure 1:
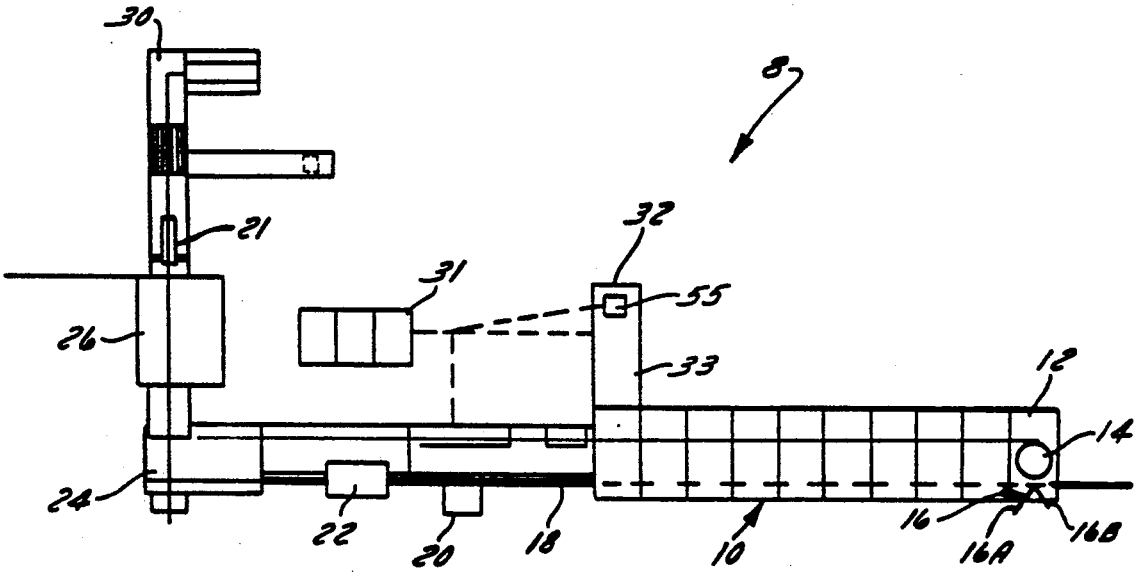
FIG. 1 is a schematic block diagram of a collating and binding system employing the present invention.

Referring to FIG. 1, a collation and binding system 8 for a saddle stitcher encompassed by the present invention is employed to produce various magazines, catalogues, brochures, periodicals, etc. containing different collections of signatures for different customers or subscribers. System 8 suitably comprises an inserter 10 having a plurality of pockets, (boxes) 12, a collating chain (conveyor) 18, a caliper 20, one or more printing units (stations) 22, a stitcher 24, a trimmer 26, a labeling station 28, and a stacker 30.

Each pocket 12 holds a supply of signatures 16. Signatures 16 are usually preprinted and folded such that one sheet, a lap sheet 16*a*, is wider than the other (short sheet) 16*b*. Each pocket 12 is equipped with a signature feeder 14 operative to selectively deliver a singular signature 16 from a supply stack within the pocket.

Collating chain or conveyor 18 collects signatures 16 from the signature feeders 14 and transports the signatures along a collation and binding line. As the signatures 16 are gathered, they move past caliper 20, which monitors the appropriate thickness of the book (signature collection) and then travel through one or more printing stations 22 where customized "on the fly" printing can be applied. After the printing, the conveyor, 18 pushes the signatures to stitcher 24 where they are bound, to create an assembled book such as by stapling or the like.

The assembled book is then diverted onto another conveyor to trimmer 26 where its edges are trimmed and labeling station 28 where a human readable mailing label is printed or otherwise applied. Thereafter, the assembled books may be conveyed to stacker 30 and readied for mail or other distribution.

The collating and binding system generally described above is conventionally controlled by a computer or programmable controller 31, the details of which are omitted as they do not form the essence of the invention. Likewise, the inserter 10, feeder 14, caliper 20, printer 22, stitcher 24, trimmer 26, labeling station 28, and stacker 30 are of conventional construction and do not require a detailed discussion except with respect to certain modifications as will be hereafter explained.

A control pocket 32 in accordance with the present invention includes a front end 33 which is adapted to deliver signatures to the collation and binding line in the same fashion as the signature feeders 14. Control pocket 32 may be used to replace one or more signature feeders 14, which are easily removed from the line. Alternatively, control pocket 32 may be added to a line of existing signature feeders 14 at whatever point desired in inserter 10. In the preferred embodiment, control pocket 32 is shown positioned as the last station on the collation and binding line so that the signatures fed therefrom form the external or cover signatures of a book. It should be appreciated however, that if control pocket 32 were located elsewhere on the collation and binding line, internal signatures of a book would be delivered. In any case, however, control pocket 32, similar to each signature feeder 14 and chain 18, is operatively tied into controller 31 which is reset for any change in the location of pocket 32 relative to position of chain 18 to ensure proper timing of the system 8.

Figure 2:
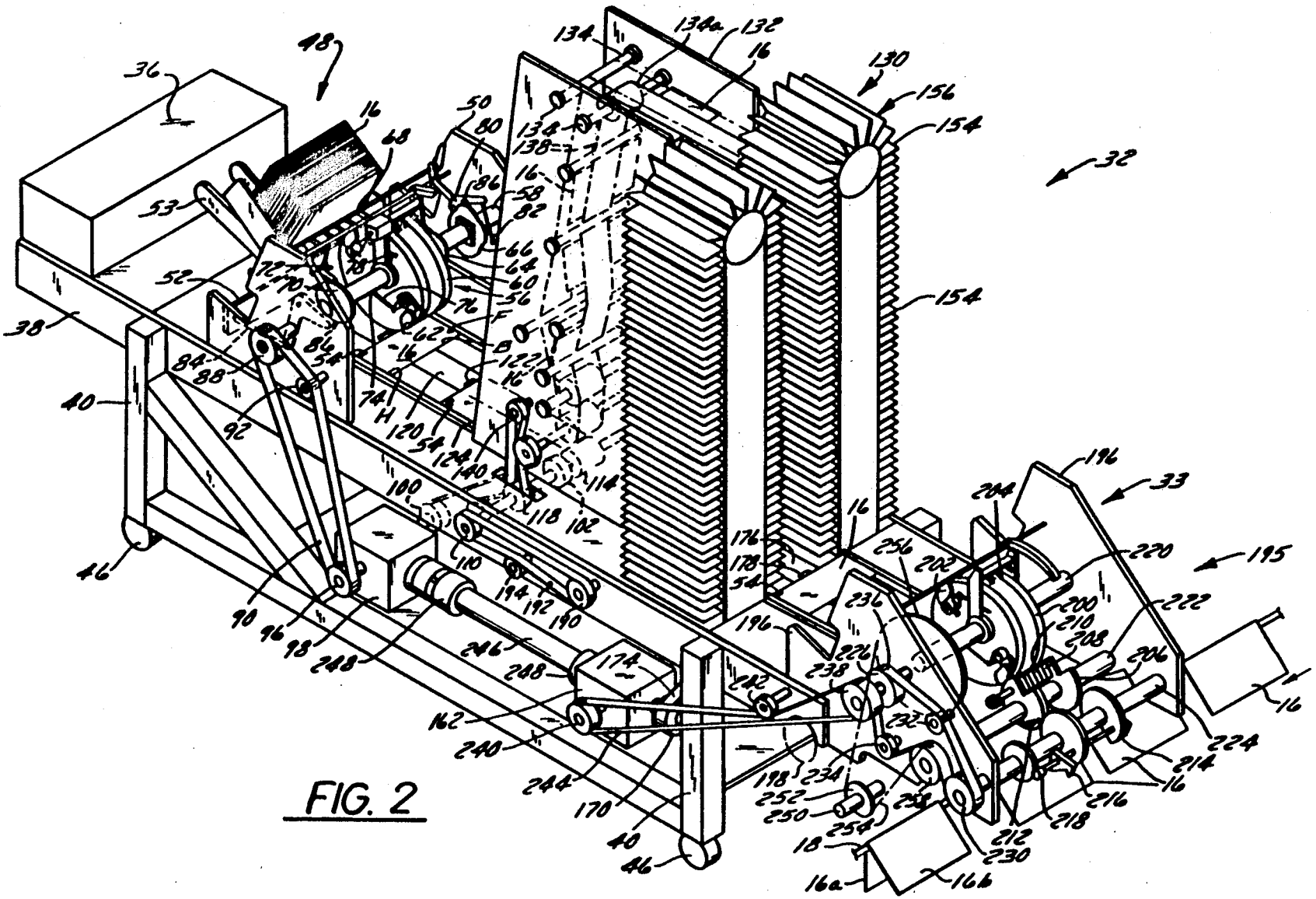
FIG. 2 is a fragmentary, perspective view of a control pocket shown in FIG. 1 with various elements broken away for clarity.
Figure 3:
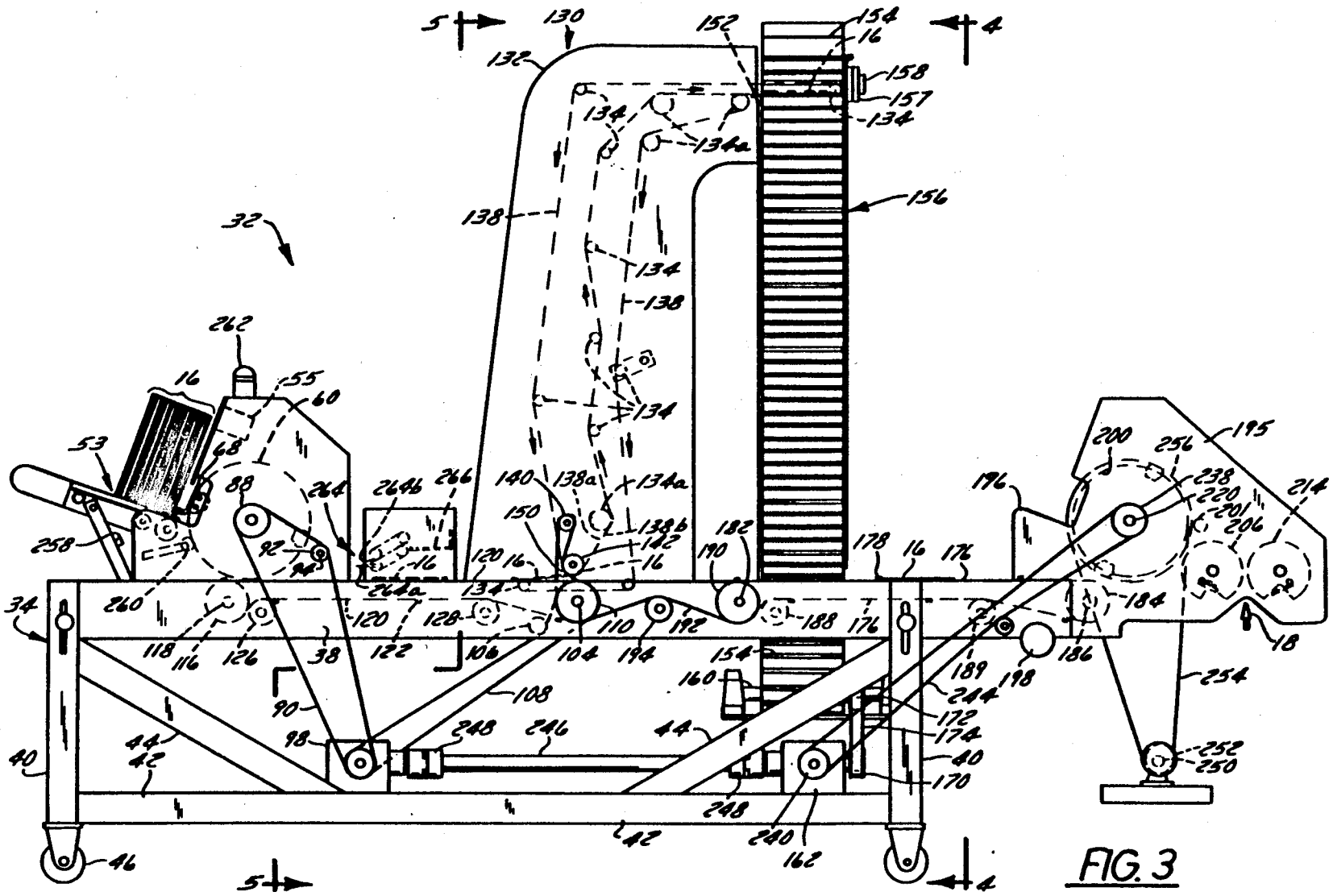
FIG. 3 is an enlarged, fragmentary side view of the control pocket shown in FIG. 1.

Turning now to FIGS. 2 and 3, control pocket 32 suitably comprises a portable table 34 on which is mounted respective suitable feeders 48 and 195 (sometimes hereinafter referred to as auxiliary feeder 48 and primary feeder 195) for selectively dispensing a supply of signatures 16 bearing machine readable (e.g., optically) coded information 54, a code reading mechanism 55 (e.g., optical scanner) disposed to read code 54 on signatures 16 in auxiliary feeder 48, an accumulator mechanism 130 interposed between feeder 48 and 195, respective conveyors 120 and 176 for conveying signatures 16 from auxiliary feeder 48 to accumulator mechanism 130 and from accumulator mechanism 130 to primary feeder 195, and a suitable drive mechanism, as will be described, for operatively coupling pocket 32 into, and driving the elements thereof in synchronism with, the bindery line.

Briefly, in operation, reader 55 scans coded information 54 on the next signature 16 to be delivered from feeder 48, while the signature is maintained in the feeder and thus relatively still. A signal reflecting the coded information is generated through computer 31 to initiate assembly of a particular demographic edition of a magazine or the like on the collating and binding line. Each signature 16 is subsequently transferred by auxiliary feeder 48, accumulator mechanism 130 and primary feeder 195 in timed sequence so that it will be delivered in synchronism with the other signatures being selectively assembled on the line according to the coded information on the signatures in hopper 53. As previously stated, it is particularly useful to employ coded information 54 in the form of bar coding on external or cover, signatures in which case control pocket 32 is the last feeding station on the line. However, the pocket 32 will perform equally well in any position on the line feeding internal signatures.

Portable table 34, suitably includes a rear jogging surface 36 connected between side rails 38. A pair of front and rear legs 40, fixed to side rails 38, are interconnected on each side by a brace 42 running parallel to side rails 38. Diagonal braces 44 are provided between legs 40 and brace 42 on each side to add further stability. Each of legs 40 is equipped with a swivel caster 46 as well as a brake and height adjusting mechanism if desired, so that table 34 may be easily transported and set into a working registration position relative to the collating and binding line.

Auxiliary feeder 48 is disposed on table 34. Because the structure and function of feeder 48 are well known to those skilled in the art, only the major portions merit description. Auxiliary feeder 48 comprises a pair of upstanding side frames 50 joined by various components of feeder. In particular, a supply hopper 53 is carried between the side frames 50 for holding a stack of signatures 16 generally upright with their folded backs or spines at the bottom of hopper, their lap sheets **16*a* facing forwardly and their short sheets 16*b* directed rearwardly. The signatures 16 are jogged or aligned manually by an operator using jogging surface 36 before they are placed in hopper 53**.

As a salient feature of the invention, each signature placed in hopper 53 is preprinted with machine readable coded information 54 representative of certain demographic categories reflective of, for example, income, occupation or hobby. The coded information also includes zip code data so the various demographic editions of books can be assembled for a particular geographical area and presorted for postal carriers. The coded information 54 can take on various forms but low density bar coded marking tolerant of the environment is highly preferred for greater accuracy in sorting. A conventional bar code reader 55 (FIG. 3) is fixed to feeder 48 and oriented to read the coded information 54 on the signature 16 next to be fed from hopper 53. Reader 55 is operatively connected with controller 31 to translate reading of the bar code into a signal which will selectively actuate certain feeders 14 on the collation and binding line to deliver certain signatures to be used in assembling a particular demographic edition. Reading the optical code while signature 16 is still in hopper 53 is particularly advantageous; signature 16 is relatively motionless during scanning of the optical code, and reading errors tend to be avoided.

Feeder 48 also includes a pickup drum 56 which is mounted for continuous rotation on a drive shaft 58 supported between frames 50. Drum 56 is composed of spaced discs 60 bearing grippers 62. Instead of furnishing a single gripper for each disc 60, a pair of grippers are oppositely located on each disc to enable feeder 48 to be run at half speed and still provide the desired feed results. Further mounted for rotation on drive shaft 58 are: gripper cams 64 for controlling the opening and closing of the grippers 62; a sucker cam 66 for regulating a sucker bar 68 positioned in front of the hopper 53; and a feed cam 70 for governing a feed mechanism 72 that properly indexes signatures 16 in hopper 53. Each of grippers 62 has a connecting rod 74 surrounded by a spring 76 which constantly urges a follower 78 at the end of rod 74 against gripper cam 64, only one of which is shown in FIG. 2. Similarly, sucker bar 68 and feed mechanism 72, include linkages 80 having rods 82 journalled to frame 50 and brace 52, respectively, and springs 84 to maintain rollers 86 on their linkages in riding contact with the sucker cam 66 and feed cam 70, respectively.

Drive for feeder 48 is provided through a belt 90. Belt 90 is entrained about a sprocket 88 mounted on drive shaft 58, an idler sprocket 92 which is mounted for rotation on a shaft 94 extending from frame 50 and an input sprocket 96. Sprocket 96 is driven by a gear box 98 connected to the drive mechanism for system 8 as will be described.

Figure 5:
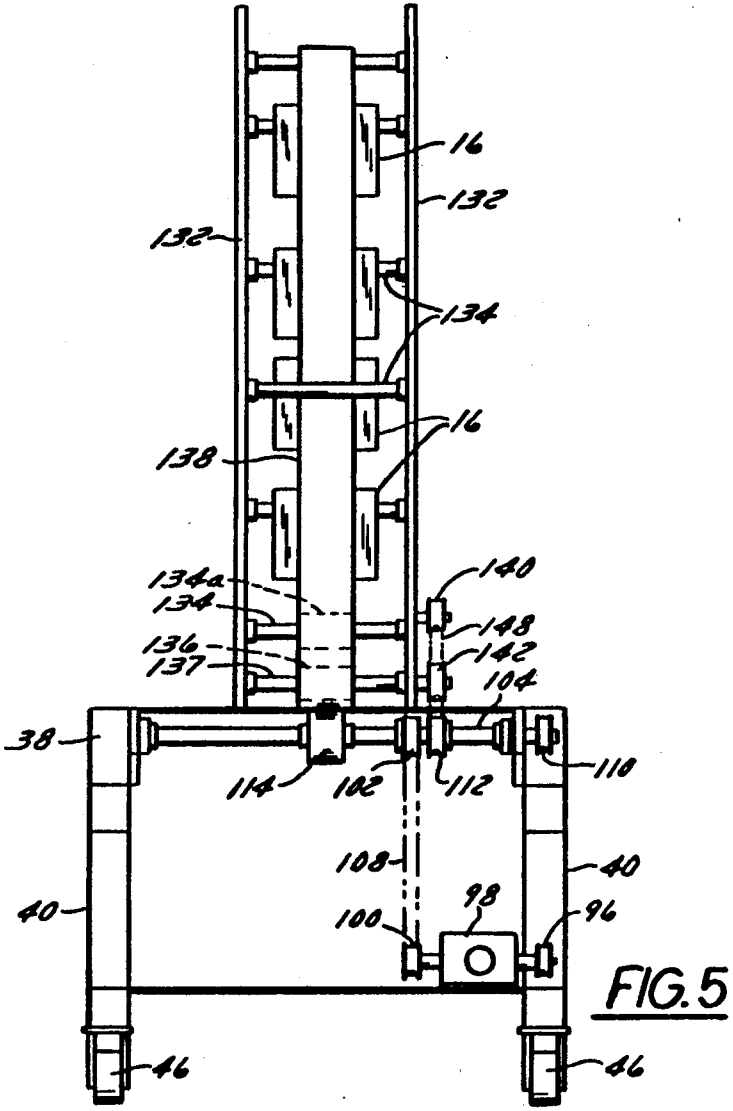
FIG. 5 is a fragmentary cross sectional view of the control pocket taken on line 5—5 of FIG. 3.

A first conveyor belt 120 is disposed to receive signatures 16 as they are dispensed from auxiliary feeder 48 and runs longitudinally of table 34 below drum 56. Referring briefly to FIG. 5, a shaft 104, extending between side rails 38, bears respective sprockets rotationally mounted thereon: a sprocket 110 which lies outside side rail 38; interior sprockets 102 and 112; and a large drive sprocket 114, which sits generally equidistant from side rails 38. A second drive sprocket 116 (FIG. 3) is disposed under drum 56 and is rotatable on a shaft 118 extending between side rails 38. Sprockets 114 and 116 cooperate to provide a path for first conveyor belt 120 running longitudinally of table 34 below drum 56. Belt 120 has a plurality of spaced pusher lugs 122 and travels between a pair of signature guides 124 (FIG. 2) disposed on table 34 parallel to the conveyor path. As seen in FIG. 3, the lower run of belt 120 may be tensioned by, for example, using idler shafts 126 and 128 mounted between side rails 38.

Drive for conveyor belt 120 is provided through a belt 108. An input sprocket 100, disposed on the other side of gear box 98 from sprocket 96, cooperates with sprocket 102 which is rotatable on shaft 104 extending between side rails 38. Sprockets 100 and 102, together with an idler shaft 106, form a path for drive belt 108.

By this arrangement, counterclockwise rotation of drive shaft 58 will cause feeding mechanism 72 to push signatures 16 forward in hopper 53, sucker bar 68 to selectively extract the forwardmost signature, and grippers 62 to close, in order to transfer the signature from the hopper 53 through 90° counterclockwise rotation of pickup drum 56. At this point, cam 64 effects opening of grippers 62 to release signature 16 in flattened position upon belt 120 which is moving forwardly toward the line by virtue of clockwise driven sprockets 114 and 102. Thus, the folded back (spine) B of signature 16 becomes the leading edge, the head H and foot F are properly aligned by and against guides 124 and the cut face C is registered against a pushing lug 122 on belt 120.

In the preferred embodiment, an accumulator mechanism 130 is used to maintain custody of each signature 16 fed from auxiliary feeder 48 for a predetermined time during which signatures 16 selectively fed from feeders 14 are assembled on the collating and binding line. Accumulator mechanism 130 includes a transfer belt 138 for intercepting each signature 16 from first conveyor belt 120, and twin timing belts 156 for receiving, storing and delivering the signatures from transfer belt 138 to a second conveyor belt 176. Referring now to FIGS. 3 and 5, a pair of side plates 132 are mounted on, and rise upwardly from, table 34. A series of rotatable idler shafts 134, idler rollers **134*a* and a nip roller 136 mounted on a shaft 137 are provided between side plates 132. Idler shafts 134, idler rollers 134*a* and nip roller 136 act together to define a path for an endless transfer belt 138. Belt 138 has overlapping portions 138*a* and 138*b* for engaging each signature 16 in sandwiching relationship. To drive transfer belt 138, idler sprockets 140, 142 (FIG. 2) are rotatably mounted on shafts 144, 137 respectively, projecting outwardly of plate 132. A drive belt 148 is disposed in driving contact with sprockets 140, and 142, and with sprocket 112. It should be appreciated that sprocket 112, which is being driven clockwise on shaft 104, will cause sprocket 142 and nip roller 136 (both mounted on shaft 137) to turn counterclockwise. Therefore, each signature 16, moving forwardly on first conveyor belt 120 is transferred to a moving portion 149 of belt 138 and then to nipping point 150 between the overlapping portions 138***a*, 138*b* of transfer belt 138 and carried upwardly along the path shown by arrows in FIG. 3.

Figure 4:
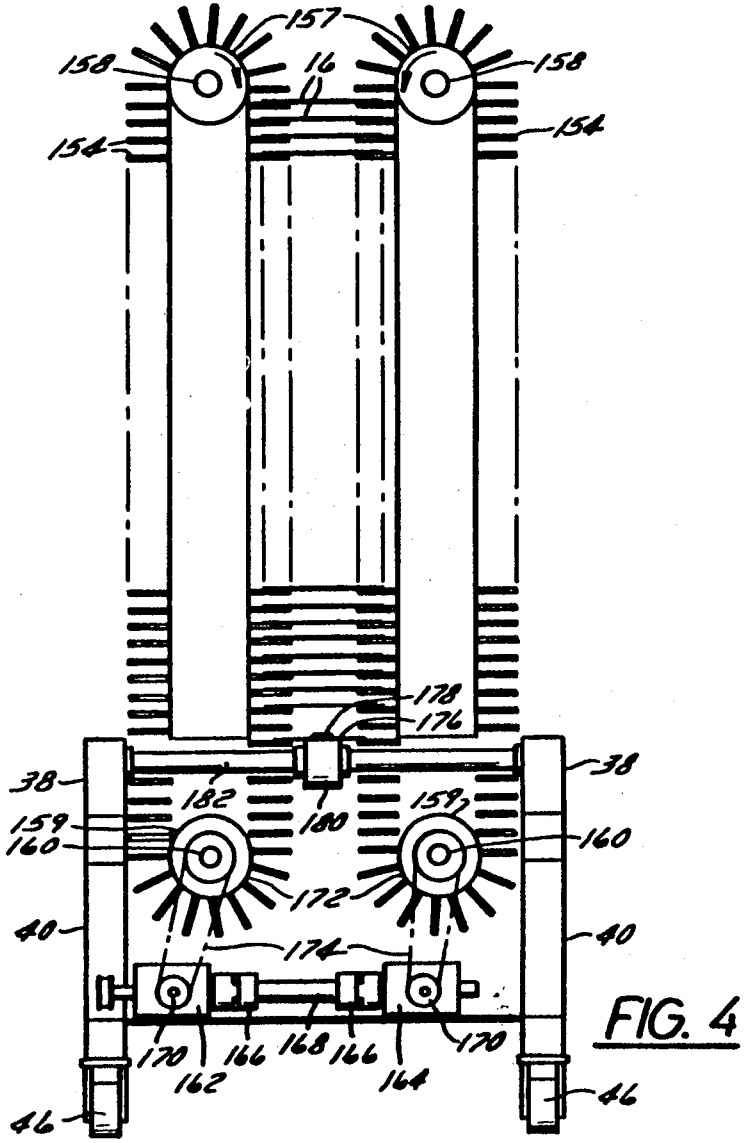
FIG. 4 is a fragmentary cross sectional view of the control pocket taken on line 4—4 of FIG. 3.

Upon arriving at upwardmost point 152, each signature 16 is delivered by transfer belt 138 in straddling relationship upon coplanar lugs 154 of twin timing belts 156. Referring now to FIG. 4, timing belts 156 are disposed on upper sprockets 157 mounted on shafts 158 and lower sprockets 159 mounted on shafts 160. Timing belts 156 are rotated in synchronism in opposite directions relative to each other by means of driven gear boxes 162, 164. Gear boxes 162, 164 are connected through flexible couplings 166 and output shaft 168. Each gearbox 162, 164 carries a sprocket 170, which works with a sprocket 172 coaxially mounted on shaft 160, to define a path for a drive belt 174. Timing belts 156 serve to maintain signatures 16 in custody and transport them downwardly as shown in FIG. 4 until they reach the plane of second conveyor belt 176 passing between timing belts 156 and carrying pushing lugs 178 from which signatures 16 will be pushed forwardly toward the collation and binding line.

A first rotatable sprocket 180 is mounted equidistant between side rails 38 on a shaft 182 connected between side rails 38. Turning again to FIG. 3, a second rotatable sprocket 184 is similarly positioned on a shaft 186 in a feeding mechanism to be described. Second conveyor belt 176 is entrained about sprockets 180, 184 and is tensioned on its lower run by idler rollers 188, 189 on table 34. Also mounted on shaft 182 outside side rails 38 is a sprocket 190 which together with sprocket 110 defines a path for a drive belt 192 tensioned by roller 194. Belt 192 transfers clockwise motion from shaft 104 to shaft 182 so that the second conveyor belt 176 can be driven in the same direction as first conveyor belt 120.

Accumulating mechanism 130 operates in its preferred embodiment adjunct to primary feeder 195 which serves to deliver each signature 16 to the collating and binding line. Referring to FIG. 2, primary feeder 195 includes a pair of upstanding side frames 196. The bottoms of side frames 196 are cut out to rest upon a support tube 198 which aligns the signature feeders 14 in inserter 10. Being similar in some respects to the auxiliary feeder 48, primary feeder 195 includes a pickup drum 200 having cam-controlled grippers 202 as previously described for handling the signatures 16. Primary feeder 195 is also similar to conventional signature feeders and includes a register stop 204 which is adjustable relative to the circumference of the drum 200 depending upon the size of the signature. Adjacent pickup drum 200 is a transfer drum 206 having a set of primary grippers 208 and a set of secondary, or lap grippers, 210. The opening and closing of grippers 208 and 210 are regulated by a follower 212 which rides against a suitable cam (not shown). An opener drum 214, including a gripper 216 which is pivotably swung open and closed by cam 218 is also provided. Each of the pickup, transfer and opener drums 200, 206, 214 are mounted on shafts 220, 222, and 224 respectively, rotatably mounted between the frames 196.

To drive primary feeder 195, the ends of the shafts 220, 222, and 224 carry drive sprockets 226, 228, 230 respectively. Sprockets 226, 228 and 230 cooperate with a pair of idlers 232, 234 also disposed outside of side frames 196 to form a path for a drive belt 236 entrained about the drive sprockets and idlers. A sprocket 238, mounted on shaft 220, cooperates with an input sprocket 240 on gear box 162 and an idler 242 on side rail 38 to define a path for a drive belt 244. Gear box 98 is connected to gear box 162 by an output shaft 246 and flexible couplings 248.

Control pocket 32 is suitably driven by the drive mechanism associated with inserter 10. As shown in FIG. 3, the drive for inserter 10 typically includes a drive shaft 250 which extends through all signature feeders 14 of inserter 10 and carries a sprocket 252. A driving force is then conveyed by a chain 254 from sprocket 250, usually via a gear reducer (not shown), to a sprocket 256 mounted inside side frame 196 on drive shaft 220. Thus, counterclockwise rotation of system drive shaft 250 will move-pickup drum 200 counterclockwise, transfer drum 206 clockwise and opener drum 214 counterclockwise. In addition, counterclockwise motion transmitted via belt 244 into gear box 162 will be translated into clockwise rotation of output shaft 246 into gear box 98. This will cause sprocket 96 to impart the counterclockwise motion necessary for drum 60 of auxiliary feeder 48. It will also produce clockwise motion of sprocket 100 and shaft 104 so that, as previously described, first and second conveyor belts 120, 176 move forwardly, transfer belt 138 moves upwardly and timing belts 156 traverse downwardly with respect to table 34 to deliver signatures to primary feeder 194.

Referring to FIG. 2, pickup drum 200 rotates counterclockwise 90° from the position shown so that cam controlled grippers 202 will close upon the folded backbone B of signature 16, being moved forwardly on second conveyor belt 176. Pickup drum 200 continues to rotate to carry signature 16 around the drum and bring the backbone B against register stop 204. In this position, pickup drum grippers 202 open, transfer drum primary grippers 208 close across both lap sheet 16*a* and short sheet 16*b* and transfer drum secondary (lap) grippers 210 close against only lap sheet 16*a*. Clockwise rotation of transfer drum 206 strips signature 16 from the pickup drum 200 and brings the gripped signature sheets 16*a*, 16*b* under an idler shaft 201 (FIG. 3) fixed between side frames 196 toward opener drum 214. Drum 214 is rotating counterclockwise. At the proper position, short sheet 16*b* is released (popped) by primary grippers 208 while lap sheet 16*a* remains held by lap grippers 210, whereupon open drum gripper 216 grabs short sheet 16*b* so that continuing rotation of drums 206, 214 spreads the customized signature 16 to drop it in straddled fashion upon the conveyor chain 18.

Signatures 16 are then conventionally gathered and selected signatures may be conventionally printed at station 22 (FIG. 1), if desired, with additional information on line before the books are stitched or stapled together. After the books have been assembled, they are conventionally diverted with the backbone B leading so that after trimming the lap, human readable mailing labels may be affixed or printed in any fashion desired so that the label may run parallel or transverse to the spine.

It should be understood that certain design parameters in system 8 must be set to accomplish the synchronism between the coded signatures 16 in pocket 32 and signatures 16 on the collation and binding line. For instance, the speed and distance of each coded signature 16 in travelling around the drum 56, upon first conveyor belt 120, transfer belt 138, timing belts 156, second conveyor belt 176 and through primary feeder 195 must be matched with the particular drive mechanism of system 8 and the length of conveyor chain 18 for any given run of books. This can be done by moving the conveyor chain 18 and signature feeders 14 at a slow speed along with the elements of control pocket 32 and comparing the paths and times traversed by the coded signatures 16 relative to their accompanying books being assembled on the line. This information can then be programmed into controller 31 along with the coded information transmitted by reader 55 to establish the proper mounting sequence between signatures moving in pocket 32 and signatures being selectively assembled on line.

Another aspect of the invention lies in the various devices for handling of miss or double feeding problems which occasionally occur during the assembly of books of signatures facilitated by use of auxiliary feeder 48. In particular, auxiliary feeder 48 includes an eye (photosensor) 258 (FIG. 3) which closely monitors the feeding of coded signatures 16 from hopper 53. If eye 258 does not sense the feeding of coded signature 16, a signal is sent to computer 31 so that a book will not be assembled until the jamming or related problem is rectified. In addition, if multiple signatures are fed from hopper 53, a thickness caliper 260 will detect such irregularity. Caliper 260 triggers a signal to computer 31 which will prevent assembly of a book and which will actuate a warning light 262 and move a rejection device 264 comprising a pivoted finger **264*a* and transfer belt 264*b* from a normally retracted position shown in horizontal position to a deflected position shown in dotted lines so that the multiple signatures are interecepted from first conveyor belt 120 by deflected finger 264*a* and are ejected into a reject tray 266. The operator responsible for supplying the signatures 16 being quickly alerted by light 262, or similar warning device, simply retrieves the coded signature and places it back in hopper 53 which generally insures the integrity of a particular demographic edition for a particular zip code. The system also contemplates the use of similar conventional misfeed sensing devices (not shown) on the individual signature feeders 14**.

It should be appreciated, the present invention greatly enhances the flexibility of assembling signatures in a collating and binding system. Such flexibility is attained without losses in operating speeds or creating additional problems in handling of signatures 16. The preferred form of the invention is easily adaptable to existing systems as either a replacement or additional unit in the inserter 10 and offers a versatility for efficient handling of signature stocks of various sizes, weight and finishes.

Unlike prior art systems which build books from a source generally remote from the inserter 10, the present invention appears to improve over existing missing book feeders or replenishment devices which exhibit shortcomings in sorting, and thereby cause additional postal expense. In addition, the present system is better suited to read the coded information representative of demographics because the coded signatures are held stationary in hopper 53 in contrast with systems that decipher coded labels or the like which are moving past a reader. By dictating the control of demographic binding from coded information directly applied on selected signatures, the present invention provides an advance which considerably improves signature sorting capability with an attendant economic savings.

While the invention has been described with reference to a preferred embodiment, those skilled in the art will appreciate that certain substitutions, alterations and omissions may be made without departing from the spirit thereof. For example, it should be understood that unfolded or blank signatures could be fed from the auxiliary feeder 48. It should also be appreciated that while the foregoing describes utilizing lap signatures, the present invention is equally adaptable to handling of non-lap signatures by modifying certain of the gripper structures with such devices as is well known in the art. Further, the invention may be utilized in a collating system where signatures are stacked on top of each other using a flattened conveyor belt. Moreover, the invention contemplates the reading of coded signatures 16 placed in a hopper of the primary feeder 195 or any signature feeder 14 on the line and subsequent delivering of coded signatures to the line in synchronism with signatures 16 being assembled on the line according to coded information 54 on signatures 16. Accordingly, the foregoing description is meant to be exemplary only and should not be deemed limitative on the scope of the invention set forth in the following claims.

I claim:

1. A system for selectively assembling signatures into a book on a collating and binding line according to coded information, the system comprising:

feeding means for supplying signatures to said collating and binding line, said signatures bearing said coded information directly thereon; and accumulating means disposed between said feeding means and said collating and binding line for delivering said coded signatures to said collating and binding line in synchronism with the signatures being previously assembled as a group on the collating and binding line according to said coded information on said coded signatures.

2. The system of claim 1, wherein said feeding means and said accumulating means are mounted on a portable table adapted for operative coupling to said collating and binding line.

3. The system of claim 1, wherein said feeding means includes means for delivering said coded signatures in a flattened position to said collating and binding line.

4. The system of claim 1, wherein said accumulating means includes timing belt means for maintaining custody of said coded signatures over a predetermined time and transfer means for delivering said coded signatures to said timing belt means.

5. The system of claim 4, wherein said feeding means is associated with means for reading said coded information on said coded signatures and developing a signal for controlling the selective delivery of signatures to said collating and binding line.

6. The system of claim 5, including means for removing said coded signatures from said timing belt means for delivery to said collating and binding line.

7. The system of claim 6, wherein said coded information is in the form of a bar code representing demographic and zip code information and said coded signatures comprise the cover signatures of the book.

8. The system of claim 1, wherein said feeding means comprises a primary-feeding means for delivering said coded signatures to said collating and binding line and an auxiliary feeding means for supplying said coded signatures to said accumulating means in order to delay delivery of said coded signatures to said primary feeding means.

9. The system of claim 8, including means for disabling the selective assembling of signatures along a collating and binding line upon detection of a feeding problem at said auxiliary feeding means.

10. A signature collating and binding system having a plurality of signature feeders spaced along a collating and binding line for selectively feeding internal and external signatures thereto according to coded information representative of demographic factors, the system comprising:

auxiliary feeding means for delivering external signatures into a signature feeder, said signatures being provided with said coded information fixed thereon;

accumulating means disposed between said auxiliary feeding means and said signature feeder for maintaining custody of said external signatures for a predetermined time before delivery to said signature feeder and collating and binding line;

means for assembling said internal signatures on said collating and binding line in accordance with said coded information; and synchronization means for effecting delivery of each of said external signatures to said collating and binding line in synchronism with the internal signatures being assembled on said collating and binding line according to said coded information on said external signatures.

11. The system of claim 10, wherein said auxiliary feeding means, said accumulating means and said signature feeder are mounted on a portable table adapted for selective operative interconnection with said collating and binding line.

12. The system of claim 11, further comprising signature guide means on said table for maintaining registration of said external signatures.

13. The system of claim 10, further including conveying means for transporting said external signatures from said auxiliary feeding means to said accumulating means and from said accumulating means to said signature feeder.

14. Apparatus for selectively gathering preprinted signatures into books on a collating and binding line, certain of said signatures having coded information printed directly thereon for producing different versions of said books corresponding to various demographic factors, said apparatus comprising:

feeding means for supplying said signatures having coded information to said collating and binding line;

means located at said feeding means for reading said coded information and initiating the gathering of selected preprinted signatures on said collating and binding line; and accumulating means positioned between said feeding means and said collating and binding line for first receiving and then delaying the delivery of said signatures having coded information for a predetermined time to said collating and binding line in synchronism with said preprinted signatures being previously gathered as a group on said collating and binding line according to said code information being detected by said reading means.

15. Apparatus of claim 14, including first conveying means between said feeding means and said accumulating means and second conveying means disposed between said accumulating means and said collating and binding line for transporting said signatures having coded information thereon.

16. Apparatus of claim 15, wherein said first and second conveying means are oriented generally transverse to said collating and binding line.

17. Apparatus of claim 15, said first and second conveying means being commonly driven by drive means for said collating and binding line.

18. Apparatus of claim 15, including a primary feeder disposed to receive said signatures having coded information from said second conveying means and adapted to be aligned and operated in said collating and binding line.

19. A method for selectively assembling signatures on a collating and binding line into books of various demographic editions comprising the steps of:

reading coded information representative of demographic characteristics printed on selected signatures to initiate the assembling of selected signatures on the collating and binding line; and delivering said selected signatures having coded information to the collating and binding line in synchronism with the signatures being previously assembled as a group on said collating and binding line according to said coded information on said selected signatures.

20. The method of claim 19, wherein the step of delivering said selected signatures having coded information printed thereon includes a further step of maintaining custody of said selected signatures for a predetermined time during which signatures are assembled on said collating and binding line.

21. A signature collating system of the type including a conveyor, a plurality of feeders, each said feeder including a hopper for maintaining a store of signatures, means for selectively delivering signatures to said conveyor and means for reading an optically readable code and selectively actuating individual ones of said feeders to progressively build different groups of signatures on said conveyor in accordance with said code, the improvement wherein:

said optically readable code is predisposed at a predetermined position on said signatures maintained in said hopper of one of said feeders;

said means for reading said code is disposed proximate to said hopper to read said code predisposed on said signature next to be delivered to said conveyor, whereby said code is substantially motionless when read; and said system further includes means for detecting misfeeding of said signatures with optically readable code from said hopper; and means for selectively diverting misfed signatures into an auxiliary hopper disposed in the vicinity of said hopper.

22. The system of claim 21, wherein said optically readable code is a bar code and said means for reading comprises a scanning bar code reader.

23. The system of claim 21 wherein each said feeder comprises:

an auxiliary feeder for selectively dispensing said signatures from said hopper;

an intermediary conveyor for receiving said signatures dispensed by said auxiliary feeder; and a primary feeder for delivering said signatures to said conveyor.

* * * * *